United States Patent [19]

Meier

[11] 4,252,212

[45] Feb. 24, 1981

[54] MUFFLER FOR COMBUSTION ENGINES

[76] Inventor: Josef Meier, Schanzstrasse/Usterstrasse, Pfäffikon, Switzerland

[21] Appl. No.: 16,524

[22] Filed: Mar. 1, 1979

[30] Foreign Application Priority Data

Mar. 8, 1978 [CH] Switzerland ..... 2546/78

[51] Int. Cl.[3] ..... F01N 7/08; F01N 1/10; F01N 1/24

[52] U.S. Cl. ..... 181/248; 181/252; 181/257

[58] Field of Search ..... 181/252, 256, 257, 243, 181/268, 282, 248, 212, 213, 222, 249–251

[56] References Cited

U.S. PATENT DOCUMENTS

| | | | |
|---|---|---|---|
| 2,016,254 | 10/1935 | Noblitt et al. | 181/251 |
| 2,929,462 | 3/1960 | Nowak | 181/252 |
| 2,990,906 | 7/1961 | Audette | 181/256 |
| 2,998,860 | 9/1961 | Everett | 181/257 |
| 3,135,350 | 6/1964 | Mattie | 181/268 |
| 3,263,772 | 8/1966 | Irwin et al. | 181/256 |
| 3,313,373 | 4/1967 | Marx | 181/252 |
| 3,415,336 | 12/1968 | Arthur et al. | 181/252 |
| 3,581,842 | 6/1971 | Hall | 181/243 |
| 3,602,334 | 8/1971 | Goodman | 181/243 |

*Primary Examiner*—L. T. Hix
*Assistant Examiner*—Thomas H. Tarcza
*Attorney, Agent, or Firm*—Weingarten, Maxham & Schurgin

[57] ABSTRACT

The muffler has an inner exhaust gas pipe and an outer casing. The inner pipe has a diameter which expands conically by about 6% between the input to the output ends of the casing. The inner pipe is also provided with longitudinal wall slots measuring about 30 mm by 2 mm and having a lip extending outwards toward the casing. The space between the inner pipe and the casing is filled with stainless steel wool. High frequencies of the vibrations in the exhaust gas are passed through the slots without appreciable gas flow through the slots, and their energy is dissipated in the wool. The wool is held in place by a metal strap wound helically on its edge about the inner pipe and welded to it. The casing is in two split halves which are held together against the inner pipe by a friction clamping element to permit differential expansion between the inner pipe and the casing.

Also disclosed is an embodiment in which there are two parallel inner pipes which branch out from a single input connection and then lead to a single output connection.

15 Claims, 6 Drawing Figures

MUFFLER FOR COMBUSTION ENGINES

BACKGROUND OF THE INVENTION

The invention relates to a muffler for the exhaust line of a combustion engine, especially that of an airplane engine.

The muffling of gases streaming out of a combustion engine is a known problem. It is usually dealt with by means of exhaust mufflers such as are generally known for powered vehicles, namely a container which is built into the exhaust line and which is divided by means of various transverse walls, called baffle plates. The purpose is to catch the gases entering the line in a pulsed manner as an input and to pass them on in a uniform stream as an output thereby eliminating popping noises. As is known, however, this can be achieved only by a drop in performance of the combustion engine which results from the back-pressure of the muffler. A repeated change in the flow direction of the gases as they pass around the baffle plates leads to a substantial drop in the efficiency.

It has therefore already been attempted to solve the problem by inserting in the exhaust line a simple perforated inner pipe which is surrounded by an outer, casing pipe. The intervening space was filled with long filament glass wool. Glass wool, however, is not very resistant to heat, and therefore melts rapidly in use to a small portion of its original volume. This damage occurs after only a short time, especially for combustion engines of small planes, since such planes are mostly still equipped with piston engines for which the temperature of the exhaust gas is higher (up to 500 degrees Celsius) than that for powered vehicle motors.

Although mufflers having the mentioned baffle plates provide long service, the muffling is nevertheless only a partial aspect. It is equally essential that this muffling also be obtained with the gases having the least possible back-pressure effect in passing through. It is possible to achieve this with very long pipes, but usually there is not enough space. There remains the fact that the demand for unrestricted passage of the exhaust gases is generally in conflict with the demand for the greatest possible muffling. Finally, there must also be considered the problem of joining together the individual parts, as well as that of maintenance. It is known that the mufflers which are ordinarily of welded construction show cracks after a time which necessitate premature replacement. The formation of these cracks takes place primarily at very high exhaust gas temperatures, and therefore is primarily found in mufflers for airplane motors. The welded seams are there stressed beyond their rating, due to the temperature differentials and the resulting differential expansion of the gas-carrying inner pipe and the other muffler parts.

One purpose of the invention is therefore to provide a muffler which combines a long-lasting muffling action for the exhaust gases generated by the motor with a practically unimpeded passage of the exhaust gases, for a minimum performance drop, so that either a smaller motor can be used for a given performance rating or a given motor can offer a higher performance.

The muffler should be suitably constructed at the connecting points between the hot and the comparatively cold parts without welding, in order to permit a differential expansion of these parts without thermal overstressing. There is also desirable a ready disassembly of the muffler for checking and maintenance.

SUMMARY OF THE INVENTION

In the novel muffler in accordance with the present invention, the exhaust gas passes through a conically widening inner conical pipe having opening slots in the wall which extend in the longitudinal direction of the pipe and having a heat- and breakage-resistant fibrous material covering the outer side of the slots.

The conical widening of the inner pipe is advantageously chosen so that the diameter of the pipe as measured at the output end of an outer casing pipe is about 6% larger than that at the input end of the casing pipe. Stainless steel has been found to be particularly useful as the fibrous material, particularly because of its ability to withstand high temperatures.

DESCRIPTION OF THE PREFERRED EMBODIMENTS

The muffler illustrated in FIGS. 1–5 has an inner pipe 1 which is intended for connection to a not-shown exhaust pipe of an also not-shown combustion engine. The connection is so made that in the FIGS. 1, 2 and 6 the exhaust gases flow from left to right. Around the inner pipe 1 and over the greater part of its length is a casing pipe 2, which is connected to the inner pipe 1 as will be shown. The inner space 3 between the inner pipe 1 and the casing pipe 2 is filled with a filler 4 of fibrous material. Stainless steel is particularly suitable for this purpose, since it is heat resistant and has particularly suitable fiber structure, the fibres being resistant to breakage and not brittle.

The inner pipe 1 expands conically in the flow direction. The widening is from a beginning diameter $D_a$ at the left input end of the casing pipe 2 to a 6% greater final diameter $D_e$ at the right output end. By means of this widening, there is provided an unrestricted flow.

Figure 3:
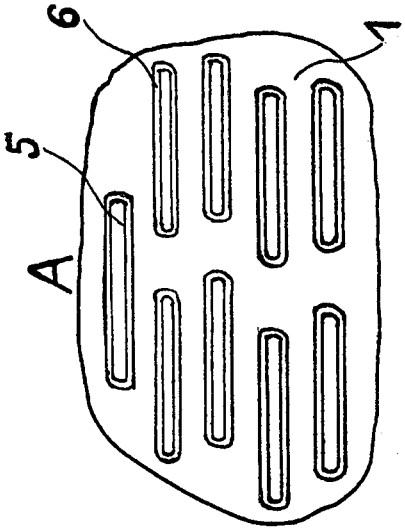
FIG. 3 is an exaggerated view of a fragment A of the inner surface of the muffler of FIGS. 1 and 2.

The inner pipe 1 is provided with a large number of openings 5 in a region extending over the entire portion lying within the casing pipe 2. As is shown in FIG. 3, these openings are approximately rectangular slots. Preferred dimensions for the openings 5 are a length of about 30 millimeters and a width of about 2 millimeters. The openings 5 are constructed by rolling a stainless steel sheet between two rollers and welding to form the inner pipe 1. One of the rollers has protrusions, which simultaneously act as stamping tools, while the other roller has matching indentations. In this manner, there occurs an expansion, similar to a deep drawing, and a simultaneous slitting open of the thus expanded region, so that each opening 5 has uniformly rounded edges 6, as can be seen from FIG. 4. These rounded edges influence the boundary layer of the gases at the inner pipe wall in such a way that, due to the small turbulences which result from the change in direction, primarily the sound waves of higher frequencies are steered through the openings 5 into the filler 4. No significant portion of the gas is thereby branched off into the openings 5. In the filler 4, the sound energy is dissipated. The result of this is that only a substantially muffled output sound is noticed in the exhaust gases from the muffler. This output sound has practically only low frequencies, and therefore is found to be relatively pleasant. The bent-out edges 6 of the openings 5 extend into the filler 4 and anchor it to some degree. The main anchoring of the filler 4, however, is provided by a steel strap 7 which is laid helically about the inner pipe 1 with its narrow edge positioned adjacent to the inner pipe 1 and welded thereto. This is the second-mentioned welded seam, which can likewise be tolerated because of the very small temperature difference between the strap 7 and the inner pipe 1. It does not matter if the strap 7 occasionally passes over one of the openings 5, since the sound muffling is not significantly affected thereby.

Figure 1:
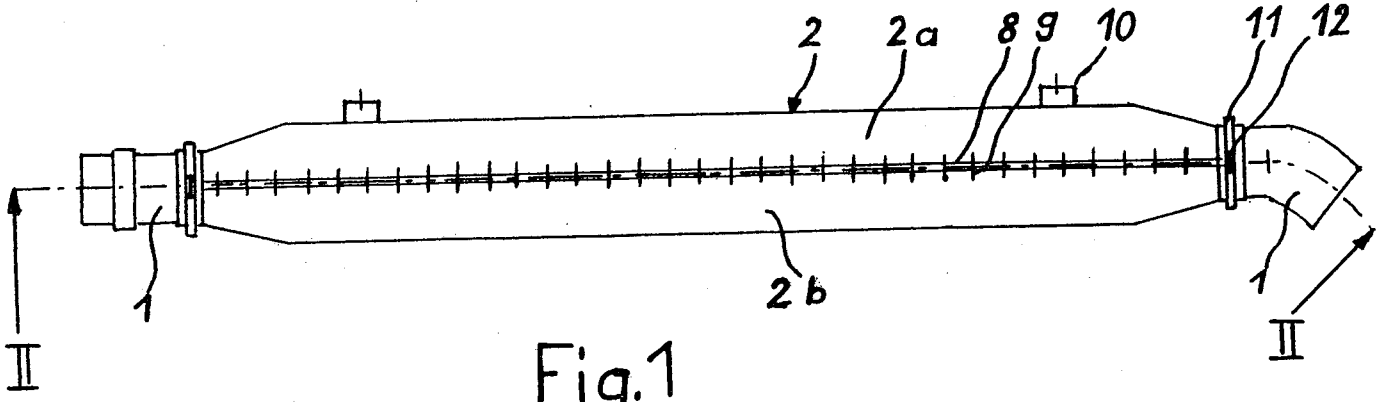
FIG. 1 is a longitudinal view of a muffler in accordance with a preferred embodiment of the invention.
Figure 2:
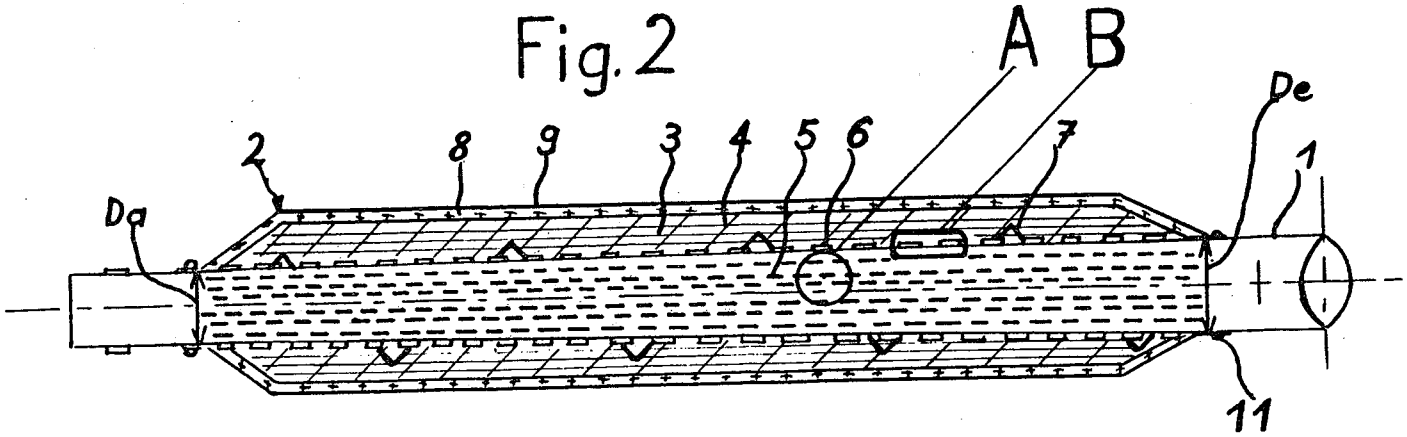
FIG. 2 is a longitudinal section of the muffler of FIG. 1 along the section lines II—II.
Figure 5:
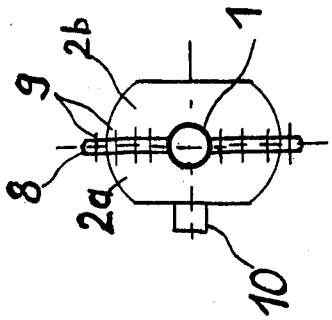
FIG. 5 is an end view of the muffler of FIG. 1.
Figure 4:
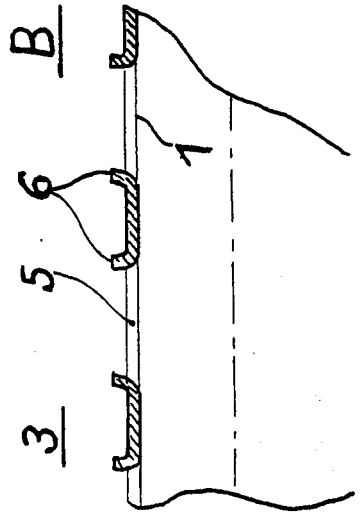
FIG. 4 is an exaggerated view of a section fragment B of the muffler of FIG. 2, showing in greater detail the opening slots in the inner pipe.

As can be seen from FIGS. 1 and 5, the casing pipe 2 consists of two identical split halves *2a, 2b,* which each have on at least one side, but preferably on both opposing sides, a flange 8. These flanges serve for receiving mechanical connecting elements. These are preferably screws 9 (here shown only symbolically), since such can be most easily loosened to permit the maintenance and cleaning of the muffler. The two split halves could also be rivetted together. One of the split halves can be provided with hanger brackets 10, by means of which the muffler can be fastened to some support element (not shown).

In the embodiment of FIGS. 1–5, the casing pipe 2 is shown having a generally oval cross-section. It can also, however, have a circular cross-section, in accordance with the installation conditions at hand.

Each end of the casing pipe 2 is connected to the inner pipe 1 by means of a connecting element 11. This connecting element must be able to permit, without significant resistance, the different longitudinal expansions of the pipe 1 and the casing pipe 2 resulting from their different temperatures. A round clamp as shown in FIG. 1 is suitable for this. It consists of a relatively thin pipe segment, or bar, which has at each end an eye for receiving a bolt 12. A tightening of the bolt 12 results in a firm connection which is nevertheless sufficiently yielding to permit the mentioned different longitudinal expansions and to thereby prevent the overstressing which would otherwise result, for instance, with welded seams.

Figure 6:
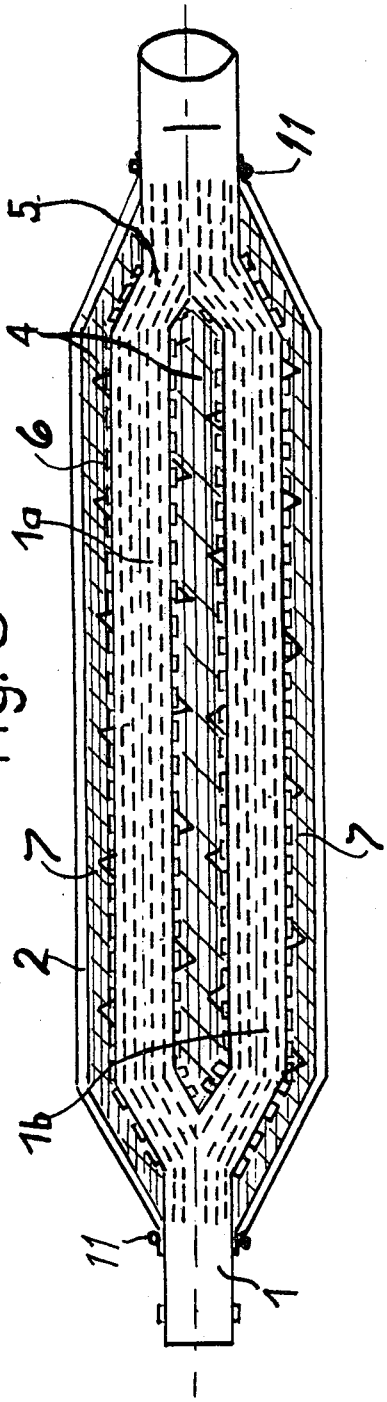
FIG. 6 is a longitudinal cross-section of another embodiment of a muffler in accordance with the invention.

FIG. 6 shows another embodiment of the present invention which is particularly suited for higher performance engines. Because of the large volumes of exhaust gases of such motors, the pipe 1 divides inside the casing pipe 2 to form of two parallel inner pipes 1*a* and 1*b*. Inner pipes 1*a* and 1*b* are provided with openings 5 and edges 6 which have the same shape and size as those of FIGS. 1 through 5 and which interact with the exhaust gases flowing through inner pipes 1*a* and 1*b* in the same manner as previously described in the embodiment of FIGS. 1 through 5 which is suited for small motors. In addition, each inner pipe 1*a* and 1*b* has a steel strap 7 wrapped helically around it. Each steel strap 7 is welded along its narrow edge to the outer surfaces of a respective inner pipe 1*a* or 1*b*. Steel straps 7 serve to anchor filler 4 which surrounds both inner pipes 1*a* and 1*b* within casing pipe 2. Each end of casing pipe 2 is connected to inner pipe 1 by means of a connecting element 11. Connecting element 11, as in the embodiment of FIGS. 1 through 5, must be able to permit the different longitudinal expansions of pipe 1 and casing pipe 2 resulting from a difference in their temperatures. Inner pipes 1*a* and 1*b* of FIG. 6 preferably expand conically in the direction of flow of the exhaust gases from the left or input end to the right or output end, as previously described for the embodiments of FIGS. 1 through 5. This increase in area provides an unrestricted flow of gases through pipe 1. Casing pipe 2 preferably has a constant diameter throughout its length. The operation of the muffler of FIG. 6 is identical to that of the muffler of FIGS. 1 through 5, except that as gases enter the left or input end, as shown in FIG. 6, the exhaust gases divide and pass through both inner pipes 1*a* and 1*b*, merging together again at the right or output end, as shown in FIG. 6, before being exhausted from the muffler. The embodiment of FIG. 6 is adapted to provide sufficient muffling for large motors.

The illustrated muffler makes possible, as tests have demonstrated, an increase of nearly 10% in the motor performance as compared with ordinary mufflers, with a simultaneous decrease of at least 8 decibel in the sound level. It is therefore particularly suitable where there are especially severe noise level restrictions. Its use for small planes, namely sport planes, was already mentioned, but it is also very well suited for construction machines, stationary equipment, and powered vehicles, especially heavy trucks.

I claim:

1. A muffler for use in the exhaust line of a combustion engine, comprising:

an outer casing pipe;

at least one inner pipe adapted for having a longitudinal flow of exhaust gases therethrough from an input end to an output end, a portion of said inner pipe being enclosed by said outer casing pipe to form an inner annular space therebetween, said inner pipe having a plurality of generally oval slots elongated in the direction of an exhaust gas flow and communicating between said exhaust gas flow in said inner pipe and said inner space, said slots being disposed along the entire longitudinal extent of said inner space; and a continuous edge formed around the entire perimeter of each of said slots and being smoothly and uniformly rounded from an inner surface of said inner pipe through said slot and terminating in an end thereof projecting into said inner space and toward said outer casing pipe, the cross-sectional area of said slot at said end within said inner space being less than the cross-sectional area of said slot at said inner surface of said inner pipe.

2. The muffler according to claim 1 wherein said inner pipe expands conically in the direction of the exhaust gas flow from said input end to said output end.

3. The muffler according to claim 1 or 2 comprising a plurality of inner pipes disposed substantially parallel to one another within said outer casing pipe and joined together at input ends thereof and at output ends thereof within portions thereof enclosed by said outer casing pipe to form a first single pipe at said input end to receive exhaust gases and a second single pipe at said output end to conduct exhaust gases from said muffler.

4. The muffler according to claim 3 wherein said first and second single pipes and said outer casing pipe are coaxial and are joined together by connecting elements adapted to permit a lengthwise expansion of said single pipes and said plurality of inner pipes relative to said outer casing pipe.

5. The muffler according to claim 4 wherein said connecting elements comprise round clamps with tightening bolts.

6. The muffler according to claim 3 further comprising:

heat and breakage resistant, sound absorbing filler material disposed within said inner space adjacent said edges; and a plurality of straps, each of said straps being wound helically about the outer wall of each of said inner pipes between said slots for anchoring said absorbing filler material.

7. The muffler according to claim 1 further comprising heat and breakage resistant, sound absorbing filler material disposed within said inner space adjacent said edges.

8. The muffler according to claim 2 wherein the diameter of said inner pipe at said output end is 6% larger than the diameter of said inner pipe at said input end.

9. The muffler according to claim 7 wherein said absorbing filler material comprises stainless steel wool.

10. The muffler according to claim 7 wherein said slots have a length of 30 millimeters and a width of 2 millimeters, said slots being spaced from one another in staggered positions along longitudinal lines parallel to the length of said outer casing pipe.

11. The muffler according to claim 1 wherein said outer casing pipe comprises two half-shells which are mechanically connected together.

12. The muffler according to claim 11 wherein said two half-shells have flanges extending therefrom and adapted to be screwed together.

13. The muffler according to claim 1 or 11 wherein said inner pipe and said outer casing pipe are connected together at each end of said outer casing pipe by connecting elements which permit a longitudinal expansion of said inner pipe relative to said outer casing pipe.

14. A muffler according to claim 13 wherein said connecting elements comprise round clamps with tightening bolts.

15. The muffler according to claim 7 or 10 further comprising a strap wound helically about the outer wall of said inner pipe between said slots for anchoring said absorbing filler material.

* * * * *